US006834824B1

(12) United States Patent
Smith

(10) Patent No.: US 6,834,824 B1
(45) Date of Patent: Dec. 28, 2004

(54) CONTINUOUS WINDER AND METHOD OF WINDING SLIT ROLLS OF LARGE DIAMETER ON SMALL DIAMETER CORES

(75) Inventor: R. Duane Smith, Fair Haven, NY (US)

(73) Assignee: Black Clawson Converting Machinery, Inc., Fulton, NY (US)

( * ) Notice: Subject to any disclaimer, the term of this patent is extended or adjusted under 35 U.S.C. 154(b) by 0 days.

(21) Appl. No.: 09/914,577

(22) PCT Filed: Mar. 14, 2000

(86) PCT No.: PCT/US00/06327

§ 371 (c)(1),
(2), (4) Date: Aug. 29, 2001

(87) PCT Pub. No.: WO00/55079

PCT Pub. Date: Sep. 21, 2000

Related U.S. Application Data

(60) Provisional application No. 60/124,649, filed on Mar. 16, 1999.

(51) Int. Cl.[7] ..... B65H 18/20; B65H 19/28; B65H 19/30

(52) U.S. Cl. ..... 242/530.1; 242/532.3; 242/541.6; 242/542.2; 242/542.3

(58) Field of Search ..... 242/527.2, 530.1, 242/530.3, 530.4, 532.3, 541.5, 541.6, 542.2, 542.3

(56) References Cited

U.S. PATENT DOCUMENTS

| | | | | |
|---|---|---|---|---|
| 1,919,518 A | | 7/1933 | Kruimel | |
| 2,498,224 A | | 2/1950 | Stone | |
| 2,579,199 A | | 12/1951 | Marcalus | |
| 2,915,255 A | | 12/1959 | Phelps | |
| 2,984,426 A | * | 5/1961 | Johnson | 242/541.5 |
| 3,009,666 A | | 11/1961 | Moser | |
| 3,066,883 A | | 12/1962 | Egan | |
| 3,258,217 A | | 6/1966 | MacArthur et al. | |
| 3,794,255 A | | 2/1974 | Harmon et al. | |
| 3,857,524 A | | 12/1974 | Melead et al. | |
| 3,889,892 A | | 6/1975 | Melead | |
| 4,111,377 A | | 9/1978 | Tetro et al. | |
| 4,191,341 A | | 3/1980 | Looser | |
| 4,444,362 A | | 4/1984 | Karr | |
| 4,445,646 A | | 5/1984 | Karr et al. | |
| 4,572,451 A | | 2/1986 | Ikeda et al. | |
| 4,634,068 A | | 1/1987 | Malkki et al. | |
| 4,988,051 A | | 1/1991 | Welschlau et al. | |
| 4,993,652 A | | 2/1991 | Moeller | |

(List continued on next page.)

FOREIGN PATENT DOCUMENTS

| | | |
|---|---|---|
| EP | 538566 | 4/1993 |
| SU | 435315 | 7/1974 |
| WO | 9000511 | 7/1990 |

OTHER PUBLICATIONS

Smith, R., "The Art of Winding Good Rolls", *Paper, Film & Foil Converter '91*.

Smith, R., "Microprocessor Control of RiderRoll Loading for New and Existing Two Drum Winders", *PaperAge '88*.

*Primary Examiner*—John M. Jillions
(74) *Attorney, Agent, or Firm*—Burr & Brown

(57) ABSTRACT

A drum type continuous winder for winding slit sections of a web onto individual cores on a core shaft (20) includes a pair of primary support arms (24, 25) having radial slots (28) that receives the core shaft from a fixed cam plate (29) permitting the core shaft to move with the cores into engagement with a moving web on a main winding drum (22) for web cutting and transfer to fresh cores. A driven nip roll (30) supported on arms (24, 25) engages the cores on the core shaft during web transfer so that the core shaft is sandwiched between the nip roll (30) and the primary drum (22) providing web transfer onto the cores free of critical speed limitations. Secondary arms (50, 51) which receive the core shaft support a secondary winding drum (52) in guide tracks (55) for radial movement into engagement with the rolls being wound.

72 Claims, 9 Drawing Sheets

U.S. PATENT DOCUMENTS 5,154,367 A 10/1992 Beisswanger
5,431,357 A 7/1995 Rüegg
5,507,450 A 4/1996 Hoar
5,611,500 A 3/1997 Smith
5,639,045 A 6/1997 Dörfel
5,673,870 A 10/1997 Fielding et al.
5,690,298 A 11/1997 Rück
5,772,149 A 6/1998 Butterworth
5,795,394 A 8/1998 Belotserkovsky et al.
5,954,291 A * 9/1999 Meinecke et al. ..... 242/541.5

* cited by examiner

CONTINUOUS WINDER AND METHOD OF WINDING SLIT ROLLS OF LARGE DIAMETER ON SMALL DIAMETER CORES

CROSS-REFERENCE TO RELATED APPLICATIONS

Priority filing benefit of (1) International PCT application PCT/US00/06327 filed Mar. 14, 2000, and published under PCT 21(2) in the English language and (2) U.S. provisional application Ser. No. 60/124,649 filed Mar. 16, 1999.

BACKGROUND OF THE INVENTION

This invention relates to a winding, method, and to a continuous drum type surface winder, adapted particularly for winding slit web material onto individual core segments carried on a common core shaft, and more particularly to a method and winder adapted to wind a slit web into individual rolls of substantial diameter, such as 60 inches or greater, on wide and relatively small diameter core shafts.

In the winding of large diameter shippable high quality rolls of web material, including films, non-woven materials, paper, paperboard material and composites onto cores, the slitting and winding operation is preferably positioned in 15 line with the web forming, and converting process. Such a continuous winding arrangement reduces production costs and scrap, and permits quick identification of process control problems. Continuous winding requires that the handoff of completed rolls, the transfer of the individual slit webs at high speed onto corresponding core segments, and the initiation of the winding process on the new core segments all be handled smoothly and at line speed.

The continuous winding of large diameter slit rolls on wide machines has presented significant problems. A particular problem arises from the fact that a long, small diameter core shaft bends under its own weight, and exhibits critical speed limitations during speed up and prior to web transfer. Such critical speed limitations are primarily the result of core shaft deflection resulting in harmonic and dynamic imbalances. Such critical speed conditions produce vibrations that interfere with the web transfer, and can result in an improper or defective start, and a start in which the rolls lack sufficient hardness. Also, shaft deflection can cause roll quality problems when winding slit rolls to a large diameter. The above identified problems are particularly acute when the core shafts are quite small such as for example, shafts for supporting three inch inside diameter cores across a wide width that may exceed 200 inches, and for winding to roll diameters that may exceed 60 inches.

A need exists for a continuous winder and method of operating a winder in which large diameter slit rolls are wound at wide machine widths in a continuous operation, in which core shaft deflection and critical speed conditions are controlled, and in which the building roll set is controlled for density throughout the winding process.

SUMMARY OF THE INVENTION

This invention provides a continuous surface type drum winder and method for winding slit webs onto individual core segments of wide web materials at high speeds into large diameter rolls on small diameter cores. In particular a winder and winding method provides the transfer of split webs of line speed onto cores supported on a long and slender core shaft, as previously described.

A first or primary driven drum is provided with a driven primary nip roll that is rotatably mounted on support arms.

These arms are pivotally mounted on primary arms that rotate about or in common with the axis of the drum. The primary arms are further provided with a slot, recess or other means by which the ends of a core shaft are supported or guided in the initial stages of winding, such that the core shaft is sandwiched between the driven primary nip roll and the driven primary drum thereby eliminating core shaft resonances and deflections that cause critical speed limitations and wrinkling at the web transfer and startup.

The buildup of the roll segments, i.e, the individual rolls, on the core shaft is begun while the core shaft is supported by the primary arms. The geometry of the arms, the primary or main drum, and the nip roll is such that the core shaft is supported during the web transfer, and during the initial roll building, in the manner that assures that the core shaft and cores are straight or parallel with the surface of the primary drum, and a good start is obtained by way of proper loading by the primary nip roll.

Also, during the roll building phase, the primary arms are programmed to move from a roll change position to a toll transfer position, in which the core shaft and the rolls thereon are transferred to a pair of support arms referred to herein as secondary support arms. The secondary support arms arm associated with a support drum that is movable on the secondary arms and in relation to the secondary arms so as to cone into a supporting engagement with the building rolls while the rolls continue at all times to be engaged with the main winding drum. In addition, the primary nip roll also continues in engagement with the winding rolls, so that the winding of the rolls continues as if on a two drum winder in which both drums are driven, either in a speed or torque mode as desired, and nipped by a driven rider roll. The primary nip roll is released after the winding rolls' weight supplies sufficient nip loading with the support drum.

The changing roll diameter is known at all times through a reading of angle transducers incorporated into the pivot arm for the primary nip roll and by the position of the secondary support drum on the secondary arms. The loading of the primary nip roll and the loading of the secondary support drum may be controlled by roll diameter as well as roll weight to provide roll density and deflection control.

The slow movement of the winding roll set, when carried by the primary arms to the position of hand off to the secondary or support arms, results in very little change in web length and therefore very little change in web tension, and allows the winding of the full roll set diameter while the roll set is maintained in part on the main drum to help minimize winding roll deflection.

The winding set, at the beginning of the wind following web transfer, is sandwiched between the main drum and the driven primary nip roll, and the core shaft is retained in slots defined in the primary arms. The secondary arms, after the completed roll set is unloaded, return to a start position that permits the primary arms, through a total rotation of about 60°, to deliver the partially wound core set to the secondary arms, while maintaining contact by the driven nip roll. The winding roll builds until initiating contact with the counterbalanced secondary support drum that is being driven at line speed. This condition of three roll or three point engagement is maintained throughout a major portion of the building of the rolls of the roll slot while the secondary arms and support drum cooperate with the primary drum to carry the weight of the building rolls and maintain the core shaft in a straight-line condition.

Upon the roll set achieving sufficient size that a rider roll is no longer required, the primary arms and their associated nip roll are fully retracted to permit the placement therein of a new core shaft with cores, the ends of which shaft are retained in a slot in the primary arms and supported on a fixed cam surface. A transfer shoe-tape web curing system is pivotally mounted on an axis common with axis of the main drum, and rotationally modes under the on-running web, and comes to rest at a point upstream of the nip and between the new cores on the core shaft and the building roll. The primary nip roll lowers onto the new core shaft. The nip roll drive goes into the speed mode to speed-up the new cores and core shaft. The primary arms then rotate approximately 5° so the core shaft moves off the cam surface and into the arm slots where the cores come to line speed by running engagement with the web on the drum at a position just prior (upstream) of the point where the web is lifted off of the drum by the transfer shoe.

An adhesive spray applicator is mounted between the primary arms and has individual spray heads operational to spray the web surfaces with adhesive upstream of the core shaft. The primary arms then rotate another approximate 5° which triggers the adhesive spray. At the same time a precision ground cut off knife comes out of the shoe into the split webs and impales the webs. The web tension and the momentum of the building rolls pull the webs through the knife thereby causing a clean straight line cut, with the adhesive causing transfer of the individual webs onto the new cores. At the same time, adhesive on the cut tails causes the tails to be attached to the surfaces of the respective completed rolls.

Then, the secondary arms index the fully wound set of rolls away from the primary drum and into a braking position where braking torque is regeneratively applied by the secondary drum to stop roll rotation. The wound roll set is then moved to an unloading position. At the same time, the shoe type web cutting system is pivoted by its arms to a lowered rest position, and the new core set, with the webs attached, continues to be wound, retained in the primary arms, and loaded against the primary drum by the driven primary arm nip roll. In this sandwiched position, the core shaft is maintained substantially free of deflection, providing a hard winding start of the individual split web sections on the respective cores, with the hardness being controlled by torque and pressure supplied by the primary nip roll. Natural deflection of the core shaft is eliminated or controlled that otherwise could cause wrinkling of the web at the start and which could cause critical speed problems.

The apparatus and method of this invention provide certain features and advantages believed to be unique to winders of this kind. These include elimination of or control of critical speed problems and related core shaft deflection problems common to continuous winding of wide and, or large slit rolls.

The sandwiching of the new cored shaft between a main driven winding drum and a driven nip roll at and following roll change eliminates the critical speed and natural deflection that causes wrinkling at the winding start.

The transfer shoe system with a pop-up knife ensures a straight clean transfer regardless of web speed.

The driven primary arm nip roll assures a good hard start and proper hardness profiling through a programmed nip and programmed torque control as a function of the winding roll's diameter through a position sensor on the driven primary nip roll's pivot.

A slow and controlled movement of the winding roll set from about −20° from a vertical center line through the main drum to about +30° winding position provides excellent roll support and causes very little web length change and therefore very little web tension change, and allows winding to the full roll set diameter while supported on the main or primary drum to help minimize deflection of the core shaft and the winding rolls.

The driven support drum supports the winding roll set in the winding position to also help minimize the winding roll's deflection.

The driven support drum assures that the building rolls have proper density profile through the programming of the nip pressure and the torque control of the drive. This system approximates the well known two drum winding system used extensively in the industry for stop/start slitting and rewinding operation.

The driven support drum is also used to support and stop the wound set after transfer by providing regenerative braking.

The primary support arms with the nip roll provide safety and ensure that the winding roll set is contained inside and within the working surfaces of the two winding drums and prevent lateral movement of the winding roll set until the set is handed off to the secondary arms.

Shaft sensing devices are incorporated in the secondary support arm to prevent excessive loading of the core shaft from excessive loading of the support drum.

The secondary arms arc used for safety to insure the winding roll set is contained inside the two winding drums. They are also used to prevent lateral movement of the winding roll set and to eject the finished roll set.

A position sensing device is incorporated into a secondary arm pivot to counter balance the arm assembly through support arm cylinders to prevent excessive loading of the core shaft by the support arms that would cause shaft deflection.

It is accordingly an important object of the invention to provide a continuous two drum surface type winder and method, in which a core shaft is supported throughout the entire winding process, from web transfer, startup, and completion, in such a manner as to eliminate bending and deflection, and reducing critical speed problems.

A further object of the invention is the provision of a two drum type winder in which a lay on roll is operable to provide three point winding control throughout a major portion of the winding of a split web onto individual core segments on a core shaft.

A still further object of the invention is the provision of a winder as outlined above, in which a secondary winding drum is controlled on secondary arms. In such a manner as to support the weight of the building rolls on the core shaft so that the core shaft may remain relatively straight throughout the winding process.

Other objects and advantages of the invention will be apparent from foregoing and following descriptions, and the accompanying drawings claims.

BRIEF DESCRIPTION OF DRAWINGS

FIGS. 4–9 respectively are sequential views showing the operation and method of the winder, in which;

FIG. 4 shows the new core shaft in position, the knife shoe is indexed to the roll chance position, and the primary nip roll is moved to the core speed-up position;

FIG. 5 illustrates the primary arms moved to a −25° position permitting the core to drop against the drum and causing the sped-up core to contact the web on the primary drum, ready to move to a roll change position in which the primary arms rotate to a −20° position, causing adhesive to spray on the web and a spring loaded knife to fire, making a transfer onto the new core;

FIG. 6 shows the wound roll being transferred to a braking position on the secondary arms and then stopped by the associated support drum while the knife shoe indexes to a parked position;

FIG. 7 shows the primary arms after being slowly indexed to a +30° position, the latch assembly on the secondary arm retracts permitting the wound roll to be lifted by a lift table to a shaft puller and recording position, as shown, permitting the support arms to index counterclockwise of FIG. 4 to a transfer position (FIG. 8), stopping at such position by a proximity switch sensing the core shaft;

FIG. 8 shows the support arms returned to the transfer position, ready to receive the core shaft from the primary arms, in which the rolls continue to build under balanced conditions and at a given diameter the primary nip roll will release and the support drum on the support arms will increase pressure for desired hardness while the primary arms indexed back to a shaft loading position is shown in FIG. 9; and, FIG. 9 illustrates the primary arms in the −30° core shaft loading position resting on the cam surface as the building rolls are supported between the drum and the driven support roll.

DESCRIPTION OF PREFERRED EMBODIMENT

Figure 1:
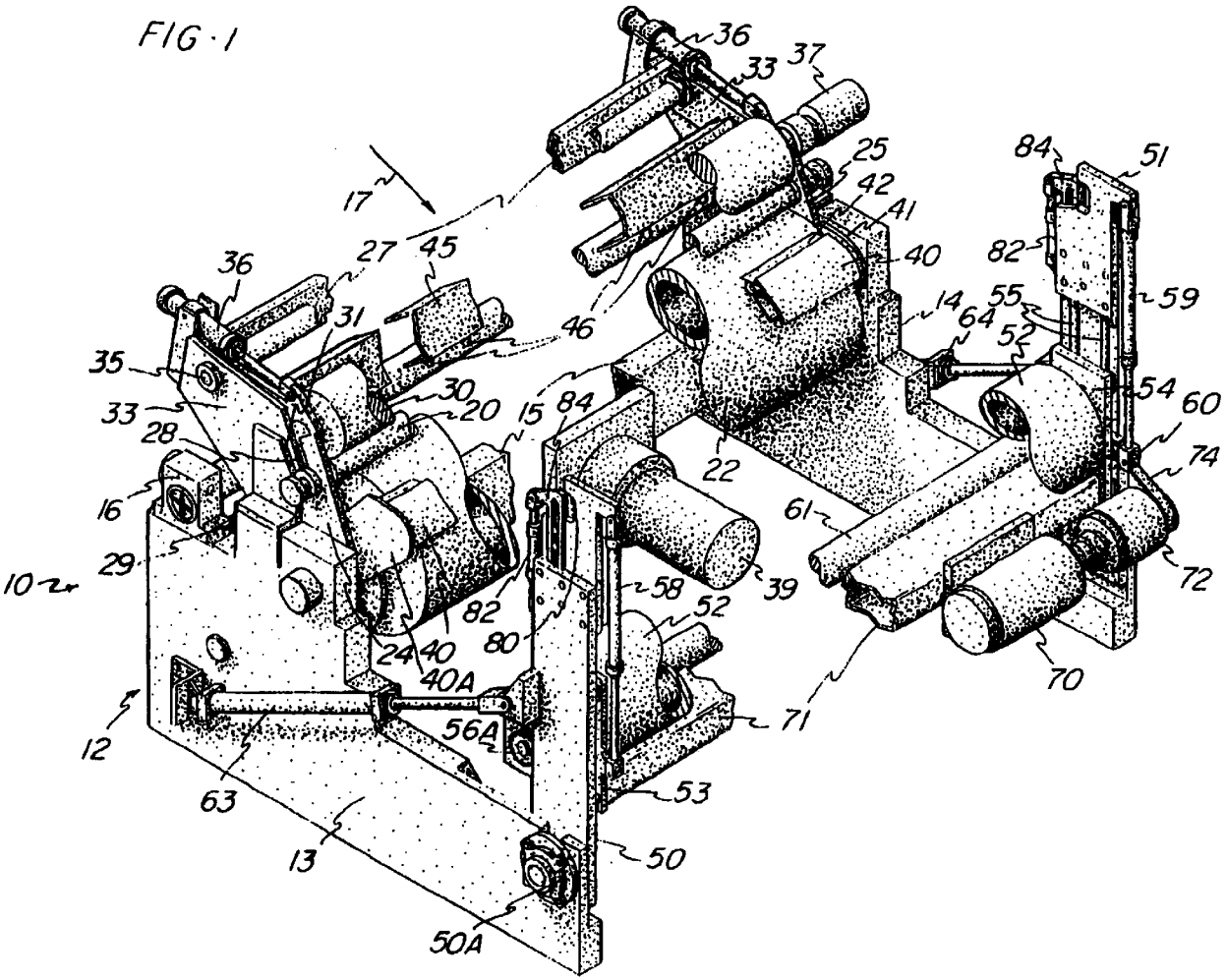
FIG. 1 is a partially broken away prospective view of a continuous winder according to this invention.

Referring to the drawings, which represent a preferred embodiment of the invention, a continuous winder particularly designed and constructed for winding on small cores a slit web into individual rolls of large diameter, is illustrated generally 10 in the figures. Winder 10 includes apparatus supported on a frame 12 including, a first side frame 13 and a spaced second side frame 14. A rectangular tubular cross member 15 extends between the frames 13 and 14 adjacent the on running side of the winder. The process direction is indicated by the arrow 17 in FIG. 1.

The winder may wind on core shafts as small as 3 inches in diameter or smaller and at widths that may exceed 200 inches or more. The diameter of the individual roll segments wound on the core shaft 20 may exceed 60 inches.

Figure 2:
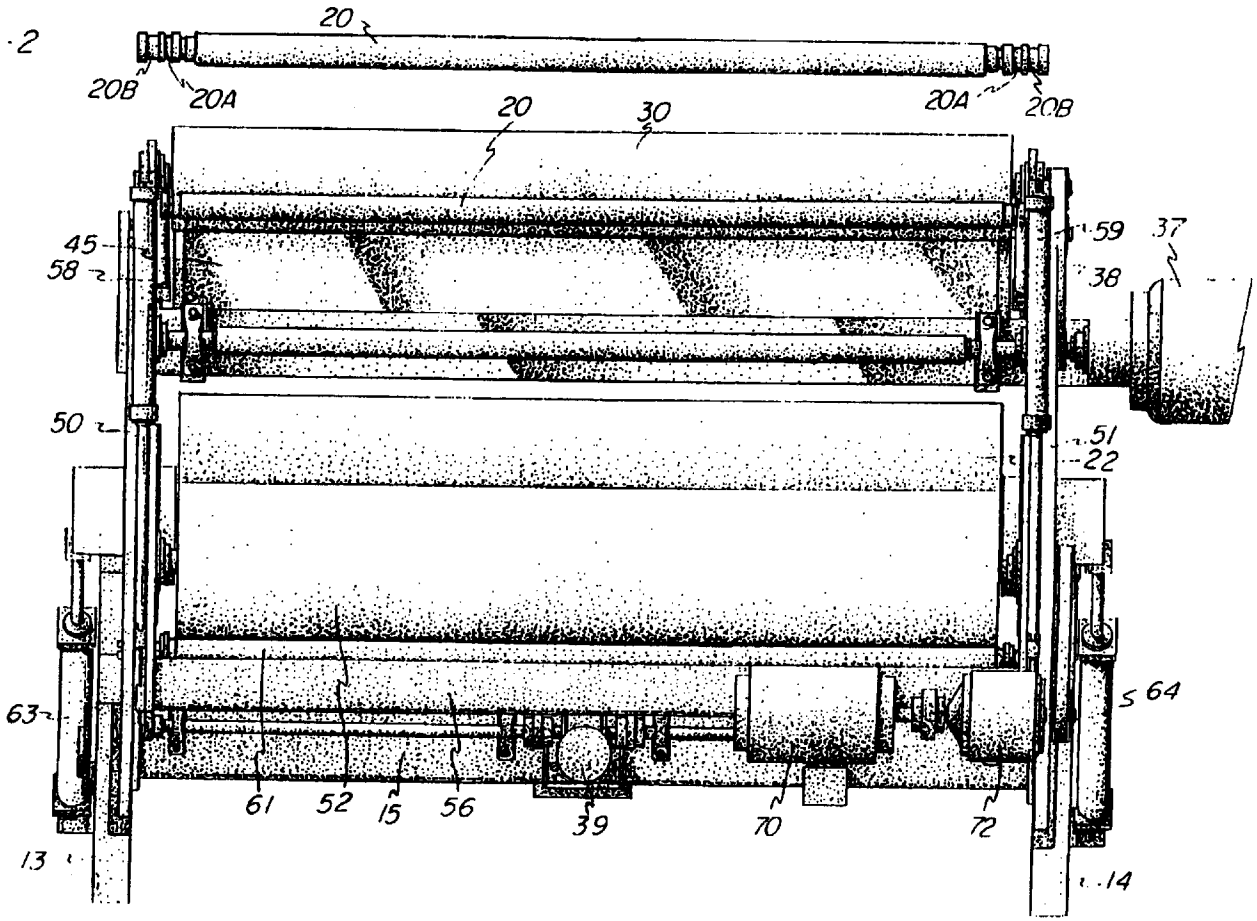
FIG. 2 is a partially broken away end view of the winder of FIG. 1 looking at the machine from the off running side, with some of the parts moved in relation to their position in FIG. 1 for the purpose of illustration.
Figure 3:
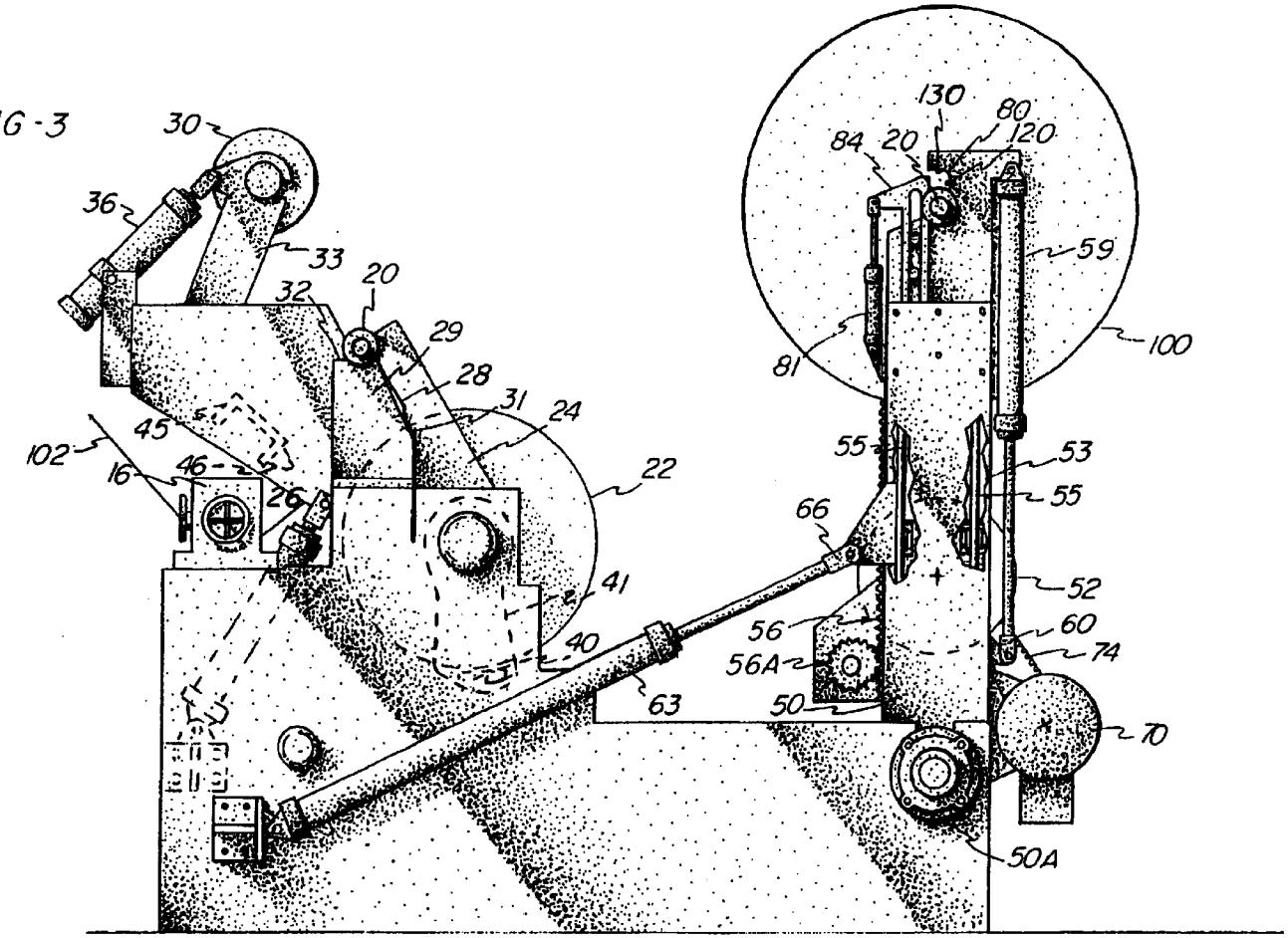
FIG. 3 is a side view of the winder of FIG. 2.

Winder 10 is intended to be used in a process line which could have an upstream slitter and which could have a spreader roll, similar to the spreader roll 16 positioned at the inlet end of the winder 10 as shown in FIGS. 1 and 3. This apparatus may include the usual process tension isolation and control rolls that lead the split webs to the winder, for winding on cores (not shown) supported on a core shaft 20. A typical core shaft 20 as used with this invention is shown in elevation in FIG. 2. Also, core shaft withdrawing and loading mechanisms may be employed, as well known in the art.

A first or primary winding drum 22 is rotatably mounted between the side frames 13 and 14, and driven by a floor mounted electric drive, not shown. A pair of primary arms 24, 25 are pivotally mounted on the side frames about a pivot axis concentric with the rotational axis of the drum 22, and are positioned at each respective transverse end of the drum.

Figure 4:
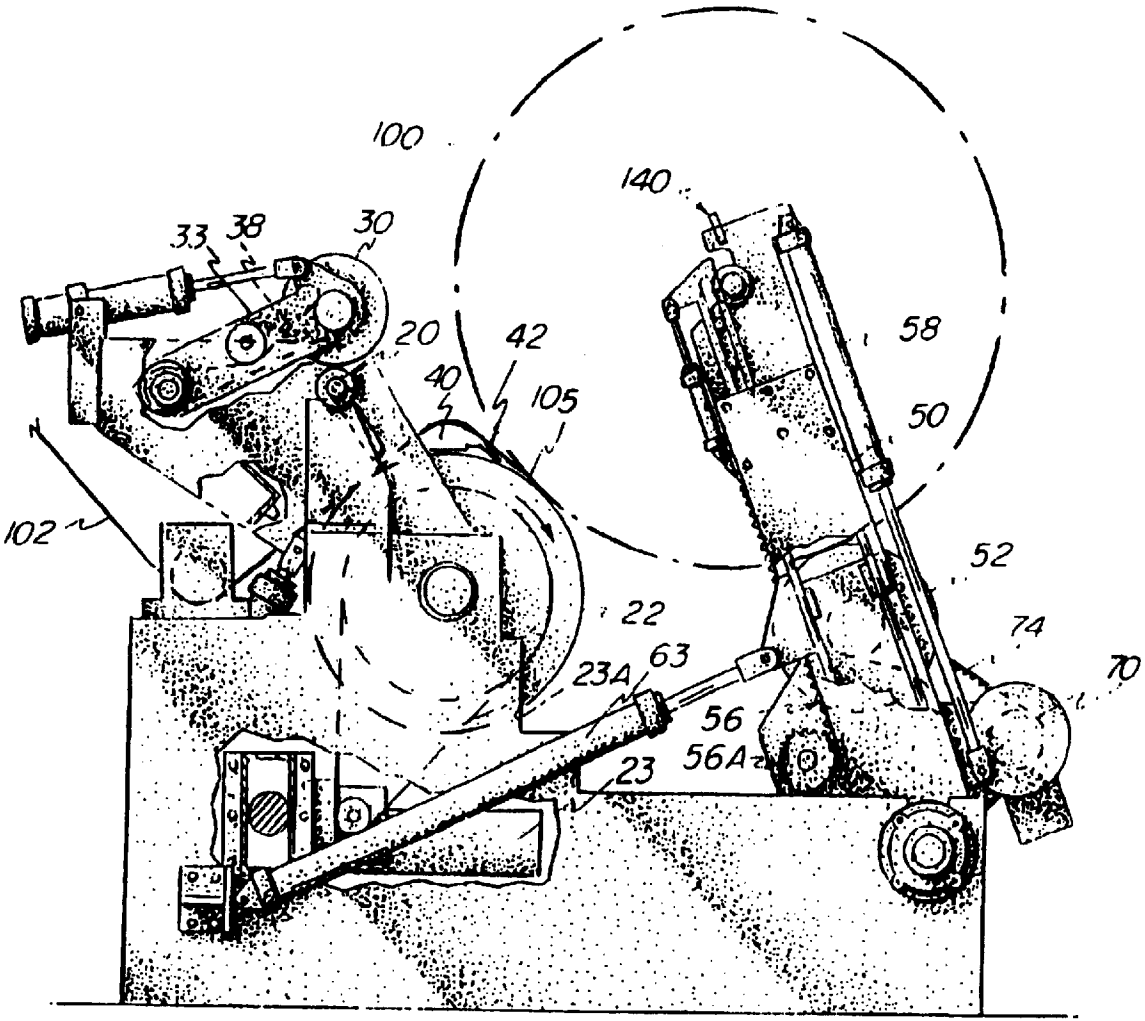
Figure 8:
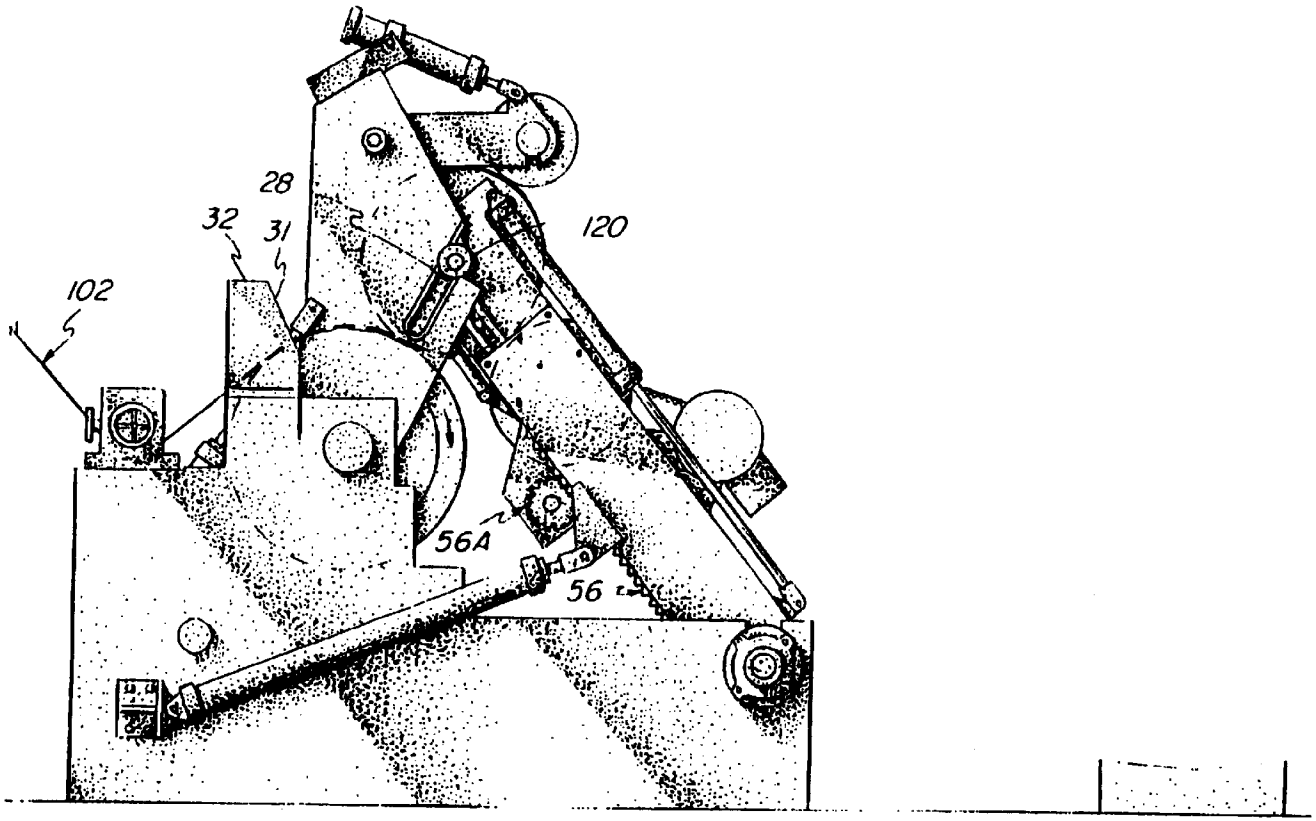

The primary arms are each formed with generally radially extending core shaft receiving recesses or slots 28 that receive the ends of the core shaft 20 during the initial winding steps. Using vertical the radial line through the center of the slot 28 as the neutral position, the arms 24 and 25 are rotatable by cylinders 26 about the axis of the main winding drum 22 from a position of about −30° as shown in FIG. 4 to a position of about +30° as shown in FIG. 8.

A fixed cam plate 29 is provided on each of the side frame members 13 and 14. Each cam plate 29 has a forward facing sloping surface 31 that is inclined at an angle substantially parallel to the slot 28 in about the −25° position of the arms and is provided further with an upper horizontal core shaft supporting cam surface 32, at least a portion of which is exposed when the primary arms 24,25 are rotated to approximately −30° position.

The primary arms 24 and 25 in turn support a driven primary arm nip roll 30. The nip roll 30 is supported on nip roll support arms 33 that are pivoted at 35 on the primary arms 24. The pivot 35 incorporates a shaft angle encoder so that the diameter of a building roll on the drum 22 may be determined. The primary nip roll is covered with silicone rubber or is plasma release coated. The positions of the arms 33 and the supported primary nip roll 30 are controlled by actuators or cylinders 36, one on each side of the winder. The cylinders 36 can move the nip roll 30 from an elevated position, as shown in FIGS. 2 and 3, to a fully lowered position in engagement with cores on the core shaft 20 as shown for example in FIGS. 1 and 6. The roll 30 is driven by a drive motor 37 and belt 38.

Figure 5:
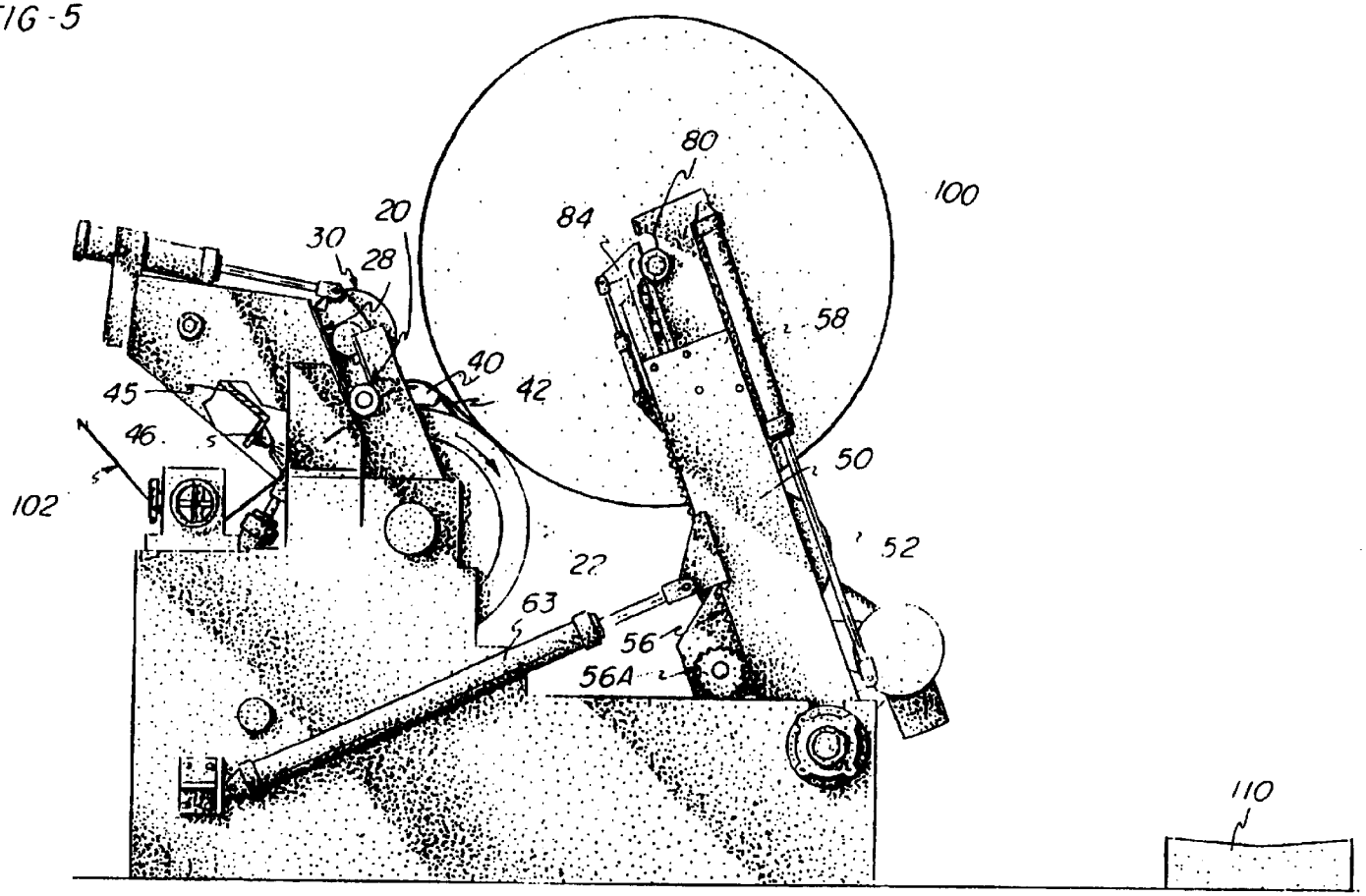

Also, as best shown in FIGS. 3 and 5, a web transfer and cut-off shoe 40 extends transversely adjacent the outer surface of the drum 22 between the frames 13 and 14 and rotates about the axis in common with the axis of the drum 22. The shoe 40 is movable on its support arms 41 between a lowered or retracted position, as shown in FIG. 3 to a rotated operative position, as shown in FIGS. 1, 4 and 5, and carries with it a web cut off knife 42 which may be extended above the shoe and into the path of the webs passing over the drum 22 for severing the webs.

The shoe 40 provides an upper curved surface that is designed to be operated with the web running over the surface. The arms 41 supporting the shoes are connected by a common shaft to a drive motor 39, FIG. 1 by which the shoe 40 may be positioned between its lowered inoperative position, as shown in outline form in FIG. 3 to its elevated operative position, including the cut off knife as shown in FIGS. 4 and 5.

A spray bar 44 is fixably mounted on a cross member 45 and supports a plurality of adjustably positionable adhesive spray nozzles 46. The spray nozzles are connected to a source of adhesive and may be aligned so that primarily only the web segments are sprayed by adhesive for transfer to a new core.

A pair of support arms 50, 51, referred to herein as secondary arms, are pivotally mounted at the off running ends of the side frames 13 and 14. An encoder 50A is incorporated into the pivot support to read out the angular position of the support arms.

The secondary arms 50 and 51 have a number of functions. First, they provide a means by which the core shaft 20 is supported during, a major portion of the winding. The arms 50, 51 also provide the support for a driven support drum, referred to herein as a secondary winding drum 52. The drum 52 is mounted on secondary, support plates 53 and 54 that are vertically movable on pairs of guide tracks 55 supported on the inner facing surfaces of the respective rotatable arms 50 and 51. The secondary plates 53 and 54 in effect form a movable carriage coupled by a cross frame member 71 and ride on parallel tracks 55 (FIG. 3) by which the secondary drum 52 may be moved vertically between a lowered position for example, in FIGS. 1 and 2, to intermediate and to elevated positions as shown respectively in FIGS. 8 and 9. The movement and position of the support drum 52 is controlled by a pair of cylinders 58 and 59 extending between the arms 50 and 51 and joining at a clevis 60 with the secondary roll support plates 53 and 54. The secondary support plates 53 and 54 move in unison by means of a rack and pinion mechanism 56 and 56A, and an interconnecting rotary shaft 61 coupling the rotational movement of pinion gears 56A together with racks 56 associated with each of the plates 53 and 54, thereby assuring uniform movement of the drum 52 by the motivating cylinders 58, 59.

The rotational movement of the secondary arms themselves is controlled by cylinders 63 and 64 one each pivotally anchored at one of the side frames 13, 14, with an actuator rod extending to a clevis 66 attached to one of the arms 50, 51 respectively. The secondary arms are movable between extreme positions by the cylinders 63, 64, these extreme positions being shown respectively in FIGS. 7 and 8.

A motor 70 and gear reducer 72 drives the driven support drum 52 through a timing belt drive 74 best shown in FIGS. 2 and 3. The motor 70 is capable of regenerative braking, for the purpose of stopping the rotation of a completed roll set as to be further described below. The motor 70 and reducer 72 are mounted to the cross frame member 71 for vertical movement as part of the secondary frame structure with the secondary support roll 52.

The upper and upstream facing edges of the secondary arms 50 and 51 are provided with rearwardly facing notches 80 that proportioned to receive an end of the core shaft 20. Cylinders 81 operate notch closing slides 84 mounted on the arms 50 and 51 by which the core shaft may be locked in position in the receiving notches 80 or by which the core shaft may be removed from the notches.

The operation of the continuous Winder 10 is best understood by reference to the sequential drawings 4–9. Referring first to FIG. 4, a fully wound roll set 100 is attached to a slit in-feeding web 102 and is being supported on the secondary arms between the main drum 22 and the support drum 52, and substantially the weight of the roll set 100 is counter balanced by hydraulic pressure in the cylinders 63, 64 so that the core shaft 20 remains straight and in a substantially neutral position. The ends 20A of the core shaft 20 are captured in the notch 80 by the closure plates 84.

A freshly cored core shaft 20 is resting on the fixed upper cam surface 32 of the cam plate 29 while the nip roll 30 that has previously retracted to permit the core shaft placement, is now lowered into engagement with the core shaft and resting on the core shaft, ready to speed-up the new cores. The knife transfer shoe 40 has been rotated from a lowered rest position to an upper operative position under the on-running web 102 and in fact lifts the on-running web over its upper surface and then downward to the nip 105 formed between the main drum and the roll set 100.

Referring to FIG. 5, upon initiation of a roll change sequence, the primary arms are rotated +5° from the −30° position shown in FIG. 4 to a −25° position shown in FIG. 5. In this position, the slot 28 clears the forward cam surface 31, and the core shaft 20 with the cores thereon drops dozen to the bottom of the slot 28 where the cores come into contact with the upper surfaces of the individual sections of the on running web 102. At this position, the nip roll and the core shaft are now turning substantially at web speed.

The movement of the primary arms from the −25° to the −20° position. FIG. 5, actuates the web cutting and transfer process. An adhesive is sprayed onto the exposed upper surface of the on running web 102, through the spaced nozzles 46 and, at the same time, the knife 42 is fired out of the shoe 40 and into the path of the overriding web. The inertia of movement of the split web causes the web sections to be severed on the knife and the individual web strips become adhered to the respective cores on the core shaft 20 to begin the winding process. The adhesive remaining on the upper surface of the webs, now web tails, serves to clue or fix the web tails to the outer circumference of the rolls of the roll set 100.

Figure 6:
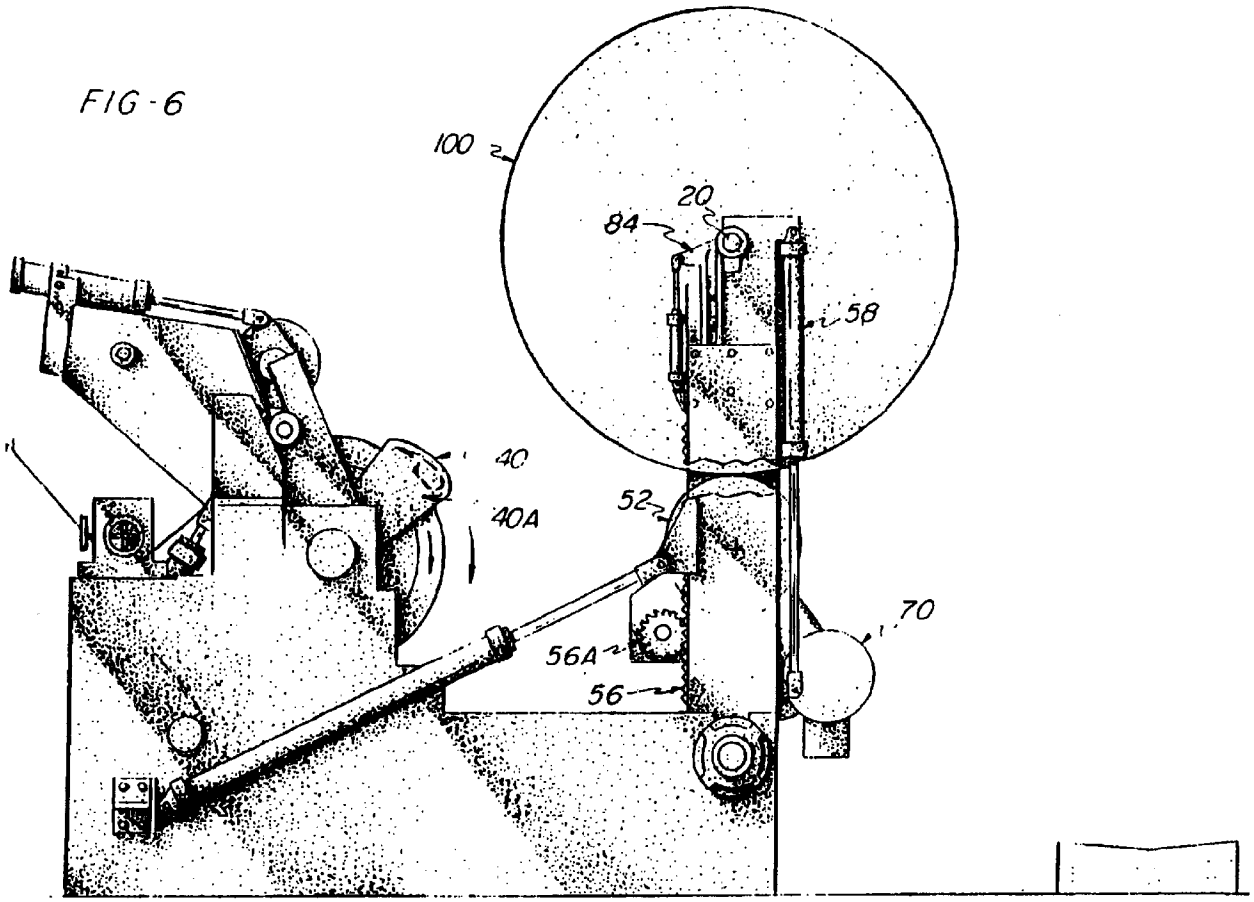

After a successful cut and transfer, the completed roll set 100 may be molted to the position shown in FIG. 6 by the cylinders 63, 64, and rotation of the roll set stopped by regenerative braking through the motor 70 and the support drum 52. In this position, the weight of the roll set is carried by the hydraulic cylinders 58, 59.

It is important to recognize at this point, that at the tiers beginning of the wind on the new core set, the core shaft is supported alone its length on the outer surface of the primary drum 22, with the core shaft ends captured within the arm slot 28 of the primary arms, and the nip is, at the same time, loaded by the driven primary roll 30. When the primary nip roll 30 is lowered, it is drib en at a speed mode to match or nearly match the speed of the new cores to line speed. The new core shaft is now sandwiched between the rolls 30 and 22 and held in the slot 28, and is held in a straight axial position thereby eliminating critical speed problems. The roll 30 prevents radial movement and the slots 28 prevent lateral movement of the core shaft. After web cut off, the primary nip roll 30 switches from web speed to a speed limited adjustable torque (SLAT) mode, and winding continues. A nip relief system is activated, by controlling the pressure in the cylinders 36, to provide nip loading between the cores and the drum 22 as a function of roll diameter, with roll diameter being measured by a shaft angle encoder at the pivot point 35 of the nip roll arms 33.

Further, after successful transfer, and following the movement of the secondary arms toward the vertical position shown in FIG. 6, the knife cut off and web transfer shoe assembly 40 may be rotated clockwise on its support arms to a rest position at the approximate 180–185° position by motor/gear box 23 & 23A.

Figure 7:
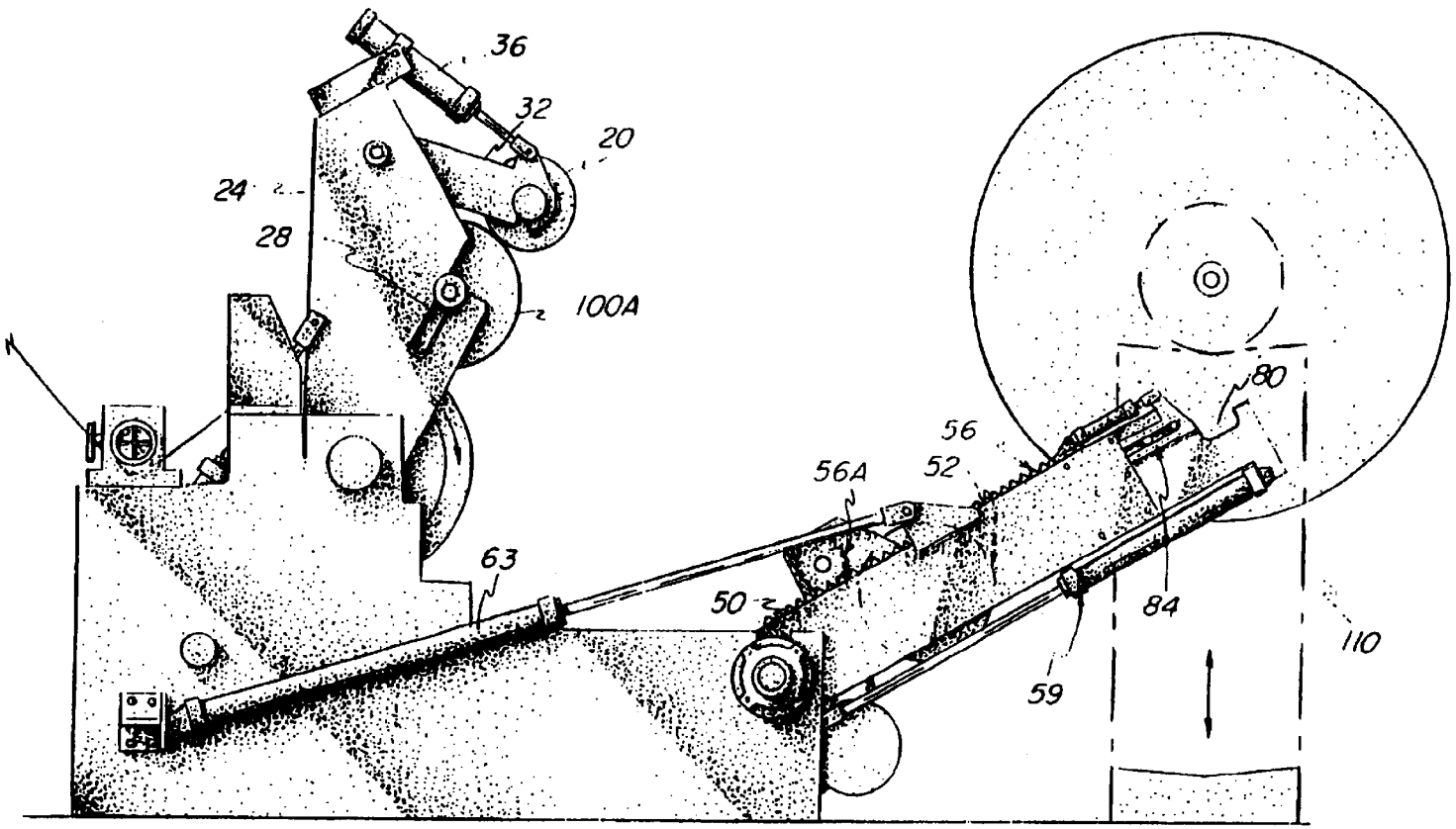

The new roll set 100A continues to build between the nip roll 30 and the primary drum 22 while the core shaft moves, as necessary, radially of the slot 28 with the building diameter of the roll set. This condition is shown in FIG. 7. During this time, the secondary arms 50, 51 after the roll set 100 has been regenerative braked to a stop by the support drum 52, may be moved to a fill clockwise unload position as shown in FIG. 7 and the core retainer notches 80 opened by the retraction of the plates 84. The elevator table lifts the wound rolls to a clearance position for the secondary arm 50, 51 to pivot to the primary/secondary transfer position as diagrammatically illustrated at 110 in the position shown in FIG. 7. The core shaft may be pulled and recorded, and a recorded shaft may be returned for readiness to be placed in the primary arms 24 in the slot 28 and on the cams 29, according to core handling apparatus well known in the art.

Also, following regenerative braking by the support drum 52, where a percentage of support drum pressure may be added to the support drum to prevent slippage during braking, and preceding the off loading of the completed roll set 100, the carriage sub-assembly for the secondary support drum 52 is fully lowered to its lowered position, by relative movement of the plates 50, 51 on the tracks 55 of the secondary arms. This fully lowered position is illustrated in FIG. 7.

During the continued winding of the roll set 100A, the primary arms 24, 25 continue to rotate and slowly move the winding set to the +30° from the vertical position as defined. After primary arms are in the 30° position, substantially as shown in FIGS. 7 and 8, and the winding roll 100A reaches a specific diameter of say 18", the secondary or support arms are moved slowly back toward the primary drum 22 and awe stopped by a proximity switch 120 on the ends of the arms, at the notch 80. During this time the secondary support drum 52 is brought into raised position in a speed mode. The proximity switch 120 indicates that the core shaft 20 is now in the notch, and the position substantially is shown in FIG. 8. At that time, the latch plate 84 is activated by the cylinders 81 to lock and secure the core shaft in the notch 80 of the secondary arms. The winding now progresses, as shown in FIG. 8, in which the building roll set is wound into the secondary drum while engagement by the nip roll 30 is maintained. The up position of the support drum, at 52, reduces the lift pressure in cylinders 59 to a counter balancing presume applied by the cylinders 59 to the effect that the loading on the roll 100A is zero or negligible so the primary nip roll 20 loading is dominant.

In a preferred embodiment, in which 60 inch diameter rolls 100 are formed, the initial engagement of the secondary arms as described above and as illustrated in FIG. 8 may take place at about a minimum 18 inch diameter and winding then continues by continuing to drive the secondary drum 52 in the speed mode with the nip roll 30 engaged. This may continue to a predetermined interim position, for example, 24 to 30 inches in diameter. At such a time, the nip roll 30 is retracted, as shown in FIG. 9, while winding continues and the support drum 52 is changed from speed control to the SLAT mode and the support drum changes from balanced to a programmed support pressure as applied by the cylinders 58, 59.

Figure 9:
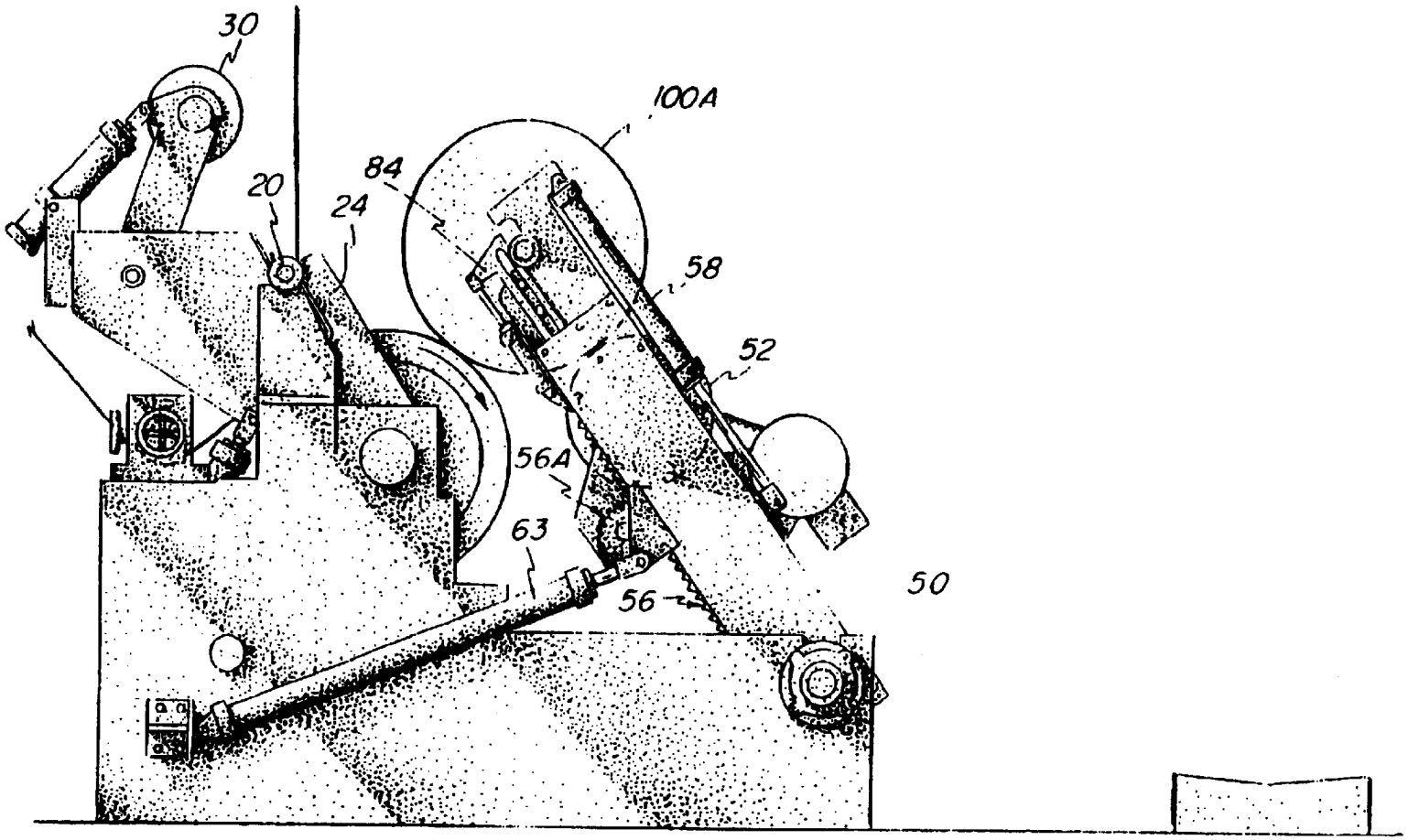

After the primary arm nip roll 30 has been fully elevated and the drive stopped, the primary arms may he rotated back to a load position shown in FIG. 9, at −30°.

The nip of the programmed support pressure by the secondary drum 52 is adjusted to control roll hardness. Another proximity switch 130 on the support arms 50, 51 senses if the drum 52 is supplying excessive support pressure and lifting of the winding set. This can be a proximity switch also located in the notch 80, when this proximity switch senses the core shaft, indicating the movement of the core shaft upwardly in the notch, the support drum pressure may be slowly decreased until the core shaft and rolls lower from the proximity switch. The winding continues until the maximum selected diameter is achieved as illustrated in FIG. 9, ready for a roll change.

The width of the slot 28 formed generally radially in the arms 24 and 25 is such that it forms a close fit with one of the support surfaces adjacent the ends of the core shaft 20. The core shaft 20 is shown in elevation at the top of FIG. 2 where it may be seen that each end of the core shaft is provided with a pair of support surfaces 20*a* and 20*b* at each end. The slots 28 form a close fit with the core shaft surface 20*a* and prevent lateral movement of the core shaft. The alignment of the slot in the arms approximates the arc of movement of the lay on roll 30 at the start-up position, as shown in FIG. 7. Therefore, at this critical time, the ends of the core shaft 20 are restrained by the walls of the slot 28 against lateral movement.

The building diameter of the roll segments as defined by the individual cores is accomplished by movement of the core shaft radially outwardly within the slot 28, against the force of the lay on roll 30.

It will also be noticed that the primary arms 24, 25, receive the core shaft at the inner of the two pairs of support surfaces 20*a* and the hand-off to the secondary arms, in the slots 80, is accomplished by receiving the core shaft in the slots 80 at the outer support surfaces 20*b*.

The hand-off of the building rolls 100A from the primary to the secondary arms, accomplished in views 7 and 8, occurs at a time when the building rolls have achieved a sufficient diameter so that the core shaft may be released from the slot 28. This is a function of the design of the machine but typically may be a diameter of 18 inches or greater. The secondary arms 50, 51, following the off-loading of the first roll set 100, are moved into a receiving position as shown in FIGS. 7 & 8 and the transfer is smoothly made by engaging the core shaft at the adjacent support surface 20*b* stopping secondary arms 50, 51 rotations by sensor 120, and closing the slots 80 with the cylinders 82 and slot retainers 84, that move in non-interfering and adjacent relation to the primary arms with counter balance pressure programming as a function of secondary arms 51, 52 position by sensor 50A provided to cylinders 63, 64.

Sequence of Operations

1. While winding set is between driven main winding drum 22 and driven support drum 52 and with driven primary arm nip roll 30 retracted, a new freshly cored shaft 20 is automatically loaded onto cams 32 around slot 28 in primary arms in the −30° from vertical centerline position.

2. Upon initiation of roll change sequence, the knife shoe 40 is indexed around drum, under web and stops in cut position on the other side of core.

3. The driven primary arm nip roll 30 lowers to cored shaft and goes into speed mode to speed up the new cores close to line speed. See FIG. 4.

4. Spray adhesive applicator nozzles 46 are in close proximity to the respective web 102.

5. Primary arms 24,25 move 5° to −25° position from vertical centerline and core shaft 20 lowers off cams 28 and onto web 102 and drum 22, straightening the natural deflection.

6. As primary arms move to −20° position, adhesive sprays onto web and pastes down the tails on the slit wound rolls 100. See FIG. 5.

7. The primary arms stop in the −20° position Which causes the precision around cutoff knife 42 to come out of the shoe 40 and impales the webs. The web tension and winding roll's momentum pulls the Webs through the knife causing a clean straight line transfer to the new cores within a slight foldback.

8. The driven primary arm nip roll 30 switches from speed mode to a speed limited adjustable torque (SLAT) mode.

9. The nip relief system is activated and provides nip loading as a function of roll diameter from an angle encoder at the pivot point of the arms 33 sensing the nip roll's position.

10. The support arms 5, 51 index the wound set 100 of slit rolls away from the drum 22 to the braking position. See FIG. 6.

11. The knife shoe 40 rotates around the drum, the knife retracts and shoe stops under the drum.

12. The driven support drum 52 remains nipped on the roll set and regenerates to stop the wound set. A percentage of support drum pressure is added to support drum to prevent slippage.

13. After the support drum reaches zero speed, the support arms 50,51 move to the unload position. See FIG. 7. In this position, the weight of the wound rolls, and the retraction of the drum 52, causes the wound rolls to sag. The extent of sag is limited by the upper edges of the roll sets coming into contact with each other, thereby limiting the extent of sag. When the roll set is supported bu the elevating table, the core shaft resumes its straight line position.

14. The table 10 raises until it supports the wound set and automatically stops.

15. The support arm latches 84 retract.

16. The wound set of rolls is lifted to the core shaft retraction position.

17. The primary arms 24,25 slowly move the winding set to the 30' from vertical position.

18. After the primary arms are in the +30 position and after the winding, set reaches a min, diameter of say 18", the support arms 50, 51 rotate back toward the drum 22 and are stopped when a proximity switch 140 on the arm 50 senses it is close to the new winding shaft. See FIG. 8. Switch 140 is shown in FIG. 4.

19. The support arm latch 84 extends and closes an interlock which allows the support arm retraction under counterbalance pressure.

20. The support drum 52 raises as the support arms pivot toward the drum 22 in the speed mode under raise pressure and switches to balance pressure at, say, 24" diameter and the winding set winds into the balanced support drum.

21. As the rolls wind, a position sensor 50A on support arm's pivot is used to program the counterbalance pressure of the support arm by the cylinders 58, 59 to prevent excessive bending of the core shaft during the winding operation.

22. When the winding set reaches a 24" to 30" diameter, the driven primary arm nip roll 30 raises and the support drum 52 changes from balance to programmed support pressure and the drive changes from speed to SLAT mode.

23. After the primary arm nip roll 30 has fully raised and the drive stopped, the primary arms 24, 25 rotate back to the load position. See FIG. 9.

24. The nip of the programmed support pressure is adjusted to control roll hardness. The proximity switch 130 on the support arm senses if the support drum is supplying excessive support pressure and lifting the winding set. If this switch senses the core shaft, the support drum pressure is slowly decreased until the rolls and core shaft lower away from the switch.

25. After step 15, a shaft puller automatically engages with the core shaft and bleeds out the inflation pressure.

26. The shaft 20 is then retracted from the wound set 100 by an automatic shaft puller.

27. The table 110 lowers the rolls to the roll platform (not shown) and tilts to eject the rolls on the platform.

28. New cut cores are either manually or automatically loaded onto the table.

29. After the table senses that new cores have been loaded, the table raises to the shaft insertion position.

30. The shafts are automatically inserted and automatically inflated.

31. An overhead hoist then picks up the shaft and when the primary arms have rotated back to the load position, the shaft is automatically loaded back onto the cam 32 around the slot 28 in the primary arms.

The winder is now ready for the next automatic roll change after the programmed footage or diameter on the winding roll is reached.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A method of continuously winding split webs onto individual cores carried on a common elongated shaft into a corresponding plurality of large diameter rolls including transfer of the split webs, substantially at line speed, from fully wound rolls onto such cores, comprising the steps of:

(a) placing the core shaft with cores thereon into surface contact with such split webs supported on a winding drum and bringing said core shaft and cores thereon up to line speed;

(b) applying a driven nip roll to said cores substantially at line speed while simultaneously constricting the ends of said core shaft against movement lateral to a radius line from the axis of rotation of said drum through said core shaft;

(c) while said core shaft is so restrained, severing the split webs at positions downstream of the region of contact of said cores with said webs by said drum and simultaneously transferring said webs onto corresponding cores on said core shaft;

(d) continuing to wind said webs onto said cores while said core shaft is so constrained laterally and constrained by said driven nip roll against core shaft deflections that would otherwise cause critical speed limitations, in which the winder has a movable secondary support drum that is movable into contact with rolls building on the cores and in spaced relation to the winding drum, further including the step of bringing the secondary drum into contact with such rolls when the rolls have attained a predetermined diameter while maintaining contact of said driven nip roll with said building rolls.

2. The method according to claim 1 in which said core shaft and the cores thereon are brought substantially to web line speed by the driven nip roll prior to contact of the cores with the split webs on the winding drum.

3. The method according to claim 1 in which said restraining step includes securing the core shaft at its ends against lateral movement by capturing the ends of the core shaft in an elongated slot that extends in a direction generally radially of the drum and provides a pathway for the core shaft with loaded cores thereon to be moved into contact with split rolls on said drum.

4. The method according to claim 1 in which the step of restraining said core shaft against lateral movement is terminated following engagement of the secondary drum with the building rolls.

5. The method according to claim 1 in which the nip roll is maintained in contact with the building rolls at least until the secondary drum has come into contact with the building rolls.

6. The method according to claim 5 in which the pressure of the nip roll on the building rolls is increased with increasing diameters of the rolls.

7. A method according to claim 1 including the step of spraying an adhesive on the inside surface of the webs leading to the fully wound rolls immediately prior to said cutting step for simultaneously gluing the tail segments of the cut webs onto the respective wound rolls and providing an adhesive surface by which the individual webs are attached to the respective cores on the core shaft.

8. The method according to claim 1 in which the secondary support drum is mounted on secondary support arms that operate independently of the primary drum and nip roll in which the secondary support arms include a core shaft support for receiving the core shaft with partially wound rolls thereon and in which the secondary drum is movable on the secondary arms into contact with the partially wound rolls when the core shaft is so supported on the support arms with the partially wound rolls supported simultaneously between the primary and secondary drums comprising the further step of counter-balancing the weight of said rolls by said secondary drum.

9. The method according to claim 8 in which said further step includes a measurement of the angle of the secondary arms and modifying the counter-balancing force of the secondary drum to prevent excessive bending of the core shaft.

10. The method according to claim 1 further including the step of applying a braking force to the wound rolls through said secondary drum to stop rotation thereof following said transferring step.

11. A method as recited in claim 1, wherein the step of restraining said core shaft against lateral movement is maintained while winding said webs on said cores with said cores being held in secondary arms, said secondary arms holding said building rolls in contact with said secondary drum.

12. A method as recited in claim 1, wherein an axis of said core shaft is located in a plane which passes through an axis of said winding drum and which defines an angle of about −20° with respect to a vertical plane which passes through said axis of said winding drum when said severing the split webs occurs, and said core shaft is moved during said continuing to wind said webs onto said cores to a position where said axis of said core shaft is in a plane which passes through said axis of said winding drum and defines which an angle of about +30° with respect to said vertical plane.

13. A method of continuously winding split webs onto individual cores carried on a common elongated shaft into a corresponding plurality of large diameter rolls including transfer of the split webs, substantially at line speed, from fully wound rolls onto such cores, comprising the steps of:

(a) placing the core shaft with cores thereon into surface contact with such split webs supported on a winding drum and bringing said core shaft and cores thereon up to line speed;

(b) applying a driven nip roll to said cores substantially at line speed while simultaneously constricting the ends of said core shaft against movement lateral to a radius line from the axis of rotation of said drum through said core shaft;

(c) while said core shaft is so restrained, severing the split webs at positions downstream of the region of contact of said cores with said webs by said drum and simultaneously transferring said webs onto corresponding cores on said core shaft;

(d) continuing to wind said webs onto said cores while said core shaft is so constrained laterally and constrained by said driven nip roll against core shaft deflections that would otherwise cause critical speed limitations, in which the nip roll is driven at a speed mode prior to the cutting step and is switched to a speed limited adjustable torque mode following the transfer of the webs onto the cores of the core shaft.

14. A drum type winder for continuously winding a split web into large diameter rolls on individual cores carried on a core shaft, comprising a frame, a main winding drum on said frame, a pair of arms mounted on said frame for rotation about an axis in common with the axis of said main winding drum, an elongated core shaft for supporting a plurality of cores thereon, a nip roll carried on said arms and engagable with cores on such core shaft, said arms being provided with generally radially extending slots through which the ends of said core shaft extend when a core is received in said slots each said slots defining walls that resist lateral movements of the core shaft ends while permitting rotation of said core shaft on said arms and movement of said core shaft radially of said drawn along said slots, said slots being open at their respective outer radial ends to receive said core shaft therein and having a radial length that permits said core shaft to move radially inwardly to place the cores thereon in engagement with a web carried on the surface of said drum while said cores are simultaneously engaged by said nip roll, thereby maintaining said core shaft in a generally straight line position for transfer of webs onto cores on said shaft.

15. The drum type winder according to claim 14 further comprising cams on said frame one each adjacent each of said arms, each of said cams defining a surface positioned generally radially outwardly of said arm slot open ends for supporting said core shaft prior to said core shaft entering said slot open ends.

16. The drum type winder according to claim 14 further comprising a pair of secondary arms rotatably mounted on said frame, a secondary support drum mounted between said secondary arms, generally radially extending guide ways on said secondary arms supporting said secondary support drum for movement along positions radially of said secondary arms, said secondary support drum being movable by said secondary arms into engagement with building rolls on said core shaft at a position in spaced relation to the engagement position of said main winding drum with said building rolls thereby cradling said building rolls between said drums.

17. The drum type winder according to claim 16 further comprising cylinders on said secondary arms providing a lifting force to said secondary support drum by which at least a substantial portion of the weight of said building rolls on said core shaft may be supported on said secondary support drum to maintain said core shaft in a generally straight line condition.

18. The drum type winder according to claim 16 in which said secondary arms are formed with core shaft-receiving notches on the ends thereof into which said core shaft ends may be received after said building rolls have built up to the point where the core shaft has reached said open ends of said slots in said primary arms, said core shaft and the rolls thereon being movable by said secondary arms about said secondary support drum to a loading position remote from said primary arms.

19. The drum type winder according to claim 18 further comprising motor drive means for said secondary drum for dynamically braking the rotation of said rolls thereon for unloading built up rolls from said winder.

20. A winder for winding a web onto a core shaft, comprising:

a winding drum, said winding drum being driven and being rotatable about a winding drum axis;

a pressure roll, said pressure roll being driven, said pressure roll being movable among a plurality of pressure roll positions, said pressure roll being rotatable about a respective pressure roll axis in each of said pressure roll positions, each of said respective pressure roll axes being substantially parallel to each other and to said winding drum axis, a support roll, said support roll being driven, said support roll being movable among a plurality of support roll positions, said support roll being rotatable about a respective support roll axis in each of said support roll positions, each of said respective support roll axes being substantially parallel to each other, to each of said respective pressure roll axes and to said winding drum axis, a first support structure for supporting a first core shaft, said first core shaft having at least one first core mounted thereon, at a first location where said first core is not in contact with said winding drum or said support roll, and at a first core shaft orientation where an axis of said first core shaft is substantially parallel to each of said respective support roll axes, each of said respective pressure roll axes and said winding drum axis, one of said pressure roll positions being a position where said pressure roll is in contact with said first core in said first location, whereby said pressure roll causes said first core shaft to rotate about said axis of said first core shaft and controls a rate of rotational acceleration of said first core shaft about said axis of said first core shaft, a guide structure for guiding said first core shaft from said first location to a second location where said first core abuts a first surface of a moving web, a second surface of the moving web being in contact with said winding drum, a second support structure for supporting said first core shaft at a third location, said third location being a position where a wound web wound on said first core abuts said winding drum and abuts said support roll such that said support roll and said winding drum together support said wound web, said third location being spaced from said first location such that a second core shaft, said second core shaft having at least one second core mounted thereon, can be positioned in said first location while said web is continuing to be wound on said wound web on said first core shaft in said third location.

21. A winder as recited in claim 20, wherein said web is a split web.

22. A winder as recited in claim 21, wherein said first core shaft has a plurality of first cores mounted thereon and aligned along said axis of said first core shaft.

23. A winder as recited in claim 20, further comprising at least two primary support arms, said primary support arms each having slots, said guide structure comprising said slots.

24. A winder as recited in claim 23, wherein said slots are substantially radially aligned with a radius of said winding drum.

25. A winder as recited in claim 23, wherein said primary support arms are rotatable about said winding drum axis.

26. A winder as recited in claim 23, wherein said pressure roll is mounted on at least two pressure roll support arms which are rotatably mounted on said primary support arms.

27. A winder as recited in claim 25, further comprising at least one cam plate, said first support structure comprising a core shaft supporting surface of said cam plate, said core shaft supporting surface of said cam plate being substantially perpendicular to axes of said slots, whereby upon rotation of said primary support arms, said first core shaft is moved off of said core shaft supporting surface of said cam plate and then along said slots, thereby moving said first core shaft from said first location to said second location.

28. A winder as recited in claim 20, further comprising a web transfer and cut-off shoe which extends transversely adjacent an outer surface of said winding drum, said web transfer and cut-off shoe being rotatable about said winding drum axis, said web transfer and cut-off shoe comprising a knife which is extendible above said shoe into a path of said web.

29. A winder as recited in claim 20, further comprising at least two secondary support arms, said second support structure comprising elements mounted on said secondary support arms.

30. A winder as recited in claim 29, further comprising at least two support roll mounting elements mounted on respective secondary support arms, said support roll mounting elements supporting said support roll and being movable relative to said secondary support arms, whereby said support roll can be moved relative to said first core shaft and can apply a desired pressure on said wound web wound on said first core.

31. A winder as recited in claim 30, further comprising a frame, at least two primary support arms, and at least one cam plate, said secondary support arms being rotatable relative to said frame along a secondary support arm axis, said secondary support arm axis being substantially parallel to each of said respective support roll axes, each of said respective pressure roll axes and said winding drum axis, said primary support arms each having slots, said guide structure comprising said slots, said winding drum being mounted on said frame, said primary support arms being mounted on said frame and being rotatable about said winding drum axis, said pressure roll being mounted on at least two pressure roll support arms which are rotatably mounted on said primary arms, said first support structure comprising a core shaft supporting surface of said cam plate, said surface of said cam plate being substantially perpendicular to axes of said slots, whereby upon rotation of said primary support arms, said first core shaft is moved off of said surface of said cam plate and then along said slots, thereby moving said first core shaft from said first location to said second location.

32. A winder as recited in claim 31, further comprising:

a first angle encoder for measuring an angle of said pressure roll support arms relative to said primary support arms, for detecting the location of said pressure roll relative to said primary support arms;

a second angle encoder for measuring an angle of said secondary support arms relative to said frame;

a web transfer and cut-off shoe which extends transversely adjacent an outer surface of said winding drum, said web transfer and cut-off shoe being rotatable about said winding drum axis, said web transfer and cut-off shoe comprising a knife which is extendible above said shoe into a path of said web;

said secondary support arms each comprising a notch for receiving an end of said first core shaft;

notch closing slides mounted on respective secondary support arms, said notch closing slides being movable between a notch slide open position, in which said first core shaft can be removed from said notches, and a notch slide closed position, in which said first core shaft is locked in said notches;

at least one proximity switch mounted on at least one of said secondary support arms, said proximity switch being positioned such that it is actuated only if said first core shaft is lifted upwardly within at least one of said notches; and a spray bar and a plurality of spray nozzles mounted on said spray bar, said spray bar being positioned such that said web passes adjacent to said spray bar and then passes adjacent to said web transfer and cut-off shoe.

33. A winder for winding a web onto a core shaft, comprising:

a winding drum, said winding drum being driven and being rotatable about a winding drum axis;

a pressure roll, said pressure roll being driven, said pressure roll being movable among a plurality of pressure roll positions, said pressure roll being rotatable about a respective pressure roll axis in each of said pressure roll positions, each of said respective pressure roll axes being substantially parallel to each other and to said winding drum axis, a support roll, said support roll being driven, said support roll being movable among a plurality of support roll positions, said support roll being rotatable about a respective support roll axis in each of said support roll positions, each of said respective support roll axes being substantially parallel to each other, to each of said respective pressure roll axes and to said winding drum axis, a first core shaft positioned at a first location, said first core shaft having at least one first core mounted thereon, a first support structure supporting said first core shaft at said first location, said first core shaft being not in contact with said winding drum or said support roll, an axis of said first core shaft being substantially parallel to each of said respective support roll axes, each of said respective pressure roll axes and said winding drum axis, said pressure roll being in contact with said first core, thereby causing said first core shaft to rotate about said axis of said first core shaft and controlling a rate of rotational acceleration of said first core shaft about said axis of said first core shaft, a second core shaft positioned at a third location, said second core shaft having at least one second core mounted thereon, a moving web being wound on said second core to form a wound web, a guide structure for guiding said first core shaft from said first location to a second location where said first core shaft abuts a first surface of said moving web, a second surface of said moving web being in contact with said winding drum, a second support structure supporting said second core shaft at said third location, where said wound web being wound on said second core abuts said winding drum and said support roll such that said support roll and said winding drum together support said wound web.

34. A winder as recited in claim 33, wherein said web is a split web.

35. A winder as recited in claim 34, wherein said first core shaft has a plurality of first cores mounted thereon and aligned along said axis of said first core shaft.

36. A winder as recited in claim 33, further comprising at least two primary support arms, said primary support arms each having slots, said guide structure comprising said slots.

37. A winder as recited in claim 36, wherein said slots are substantially radially aligned with a radius of said winding drum.

38. A winder as recited in claim 36, wherein said primary arms are rotatable about said winding drum axis.

39. A winder as recited in claim 36, wherein said pressure roll is mounted on at least two pressure roll support arms which are rotatably mounted on said primary arms.

40. A winder as recited in claim 38, further comprising at least one cam plate, said first support structure comprising a core shaft supporting surface of said cam plate, said core shaft supporting surface of said cam plate being substantially perpendicular to axes of said slots, whereby upon rotation of said primary support arms, said first core shaft is moved off of said core shaft supporting surface of said cam plate and along said slots, thereby moving said first core shaft from said first location to said second location.

41. A winder as recited in claim 33, further comprising a web transfer and cut-off shoe which extends transversely adjacent an outer surface of said winding drum, said web transfer and cut-off shoe being rotatable about said winding drum axis, said web transfer and cut-off shoe comprising a knife which is extendible above said shoe into a path of said web.

42. A winder as recited in claim 33, further comprising at least two secondary support arms, said second support structure comprising elements mounted on said secondary support arms.

43. A winder as recited in claim 42, further comprising at least two support roll mounting elements mounted on respective secondary support arms, said support roll mounting elements supporting said support roll and being movable relative to said secondary support arms, whereby said support roll can be moved relative to said second core shaft and can apply a desired pressure on said wound web wound on said second core.

44. A winder as recited in claim 43, further comprising a frame, at least two primary support arms, and at least one cam plate, said secondary support arms being rotatable relative to said frame along a secondary support arm axis, said secondary support arm axis being substantially parallel to each of said respective support roll axes, each of said respective pressure roll axes and said winding drum axis, said primary support arms each having slots, said guide structure comprising said slots, said winding drum being mounted on said frame, said primary support arms being mounted on said frame and being rotatable about said winding drum axis, said pressure roll being mounted on at least two pressure roll support arms which are rotatably mounted on said primary arms, said first support structure comprising a core shaft supporting surface of said cam plate, said surface of said cam plate being substantially perpendicular to axes of said slots, whereby upon rotation of said primary support arms, said first core shaft is moved off of said surface of said cam plate and along said slots, thereby moving said first core shaft from said first location to said second location.

45. A winder as recited in claim 44, further comprising:

a first angle encoder for measuring an angle of said pressure roll support arms relative to said primary support arms, for detecting the location of said pressure roll relative to said primary support arms;

a second angle encoder for measuring an angle of said secondary support arms relative to said frame;

a web transfer and cut-off shoe which extends transversely adjacent an outer surface of said winding drum, said web transfer and cut-off shoe being rotatable about said winding drum axis, said web transfer and cut-off shoe comprising a knife which is extendible above said shoe into a path of said web;

said secondary support arms each comprising a notch for holding an end of said second core shaft;

notch closing slides mounted on respective secondary support arms, said notch closing slides being movable between a notch slide open position, in which said second core shaft can be removed from said notches, and a notch slide closed position, in which said second core shaft is locked in said notches;

at least one proximity switch mounted on at least one of said secondary support arms, said proximity switch being positioned such that it is actuated only if said second core shaft is lifted upwardly within at least one of said notches; and a spray bar and a plurality of spray nozzles mounted on said spray bar, said spray bar being positioned such that said web passes adjacent to said spray bar and then passes adjacent to said web transfer and cut-off shoe.

46. A method of winding a web onto a core shaft, comprising:

positioning a first core shaft on a first support structure at a first location, said first core shaft having at least one first core mounted thereon;

bringing a pressure roll into contact with said first core shaft, said pressure roll having a pressure roll axis which is substantially parallel to a pressure roll axis of said first core shaft;

driving said pressure roll about said pressure roll axis, thereby causing said first core shaft to rotate about said first core shaft axis due to said contact between said pressure roll and said first core shaft;

moving said first core shaft from said first location to a guide structure and through said guide structure to a second location, in which said first core abuts a first surface of a moving web, a second surface of said moving web being in contact with a winding drum, an axis of said first core shaft in said second location being substantially parallel to an axis of said winding drum;

cutting said moving web to produce a first tail end of said web and a first leading end of said web;

contacting said first leading end of said web with said first core;

initiating winding of said web onto said first core;

continuing winding of said web on said first core to produce a growing wound web wound on said first core, said growing wound web being supported by said winding drum and being pressured by said pressure roll;

continuing winding of said web on said first core while bringing into contact with said growing wound web a support roll, said support roll having a support roll axis which is parallel to an axis of said first core, whereby said growing wound web is supported by said winding drum and said support roll;

continuing winding of said web on said first core while said growing wound web is being supported by said winding drum and said support roll, and said first core shaft is being held in place by a second support structure;

continuing winding of said web on said first core while positioning a second core shaft on said first support structure at said first location, said second core shaft having at least one second core mounted thereon;

continuing winding of said web on said first core while bringing said pressure roll into contact with said second core, said pressure roll axis being substantially parallel to an axis of said second core shaft;

continuing winding of said web on said first core while driving said pressure roll about said pressure roll axis, thereby causing said second core shaft to rotate about said second core shaft axis due to said contact between said pressure roll and said second core;

continuing winding of said web on said first core while moving said second core shaft from said first location to a guide structure and through said guide structure to said second location, in which said second core abuts said first surface of said moving web, said second surface of said moving web being in contact with said winding drum, an axis of said second core shaft in said second location being substantially parallel to an axis of said winding drum;

cutting said moving web to produce a second tail end of said web and a second leading end of said web;

contacting said second leading end of said web with said second core;

initiating winding of said web onto said second core; and moving said first core shaft, said first core and said wound web wound on said first core to a removal position.

47. A method as recited in claim 46, wherein said web is a split web.

48. A method as recited in claim 47, wherein said first core shaft has a plurality of cores aligned along said axis of said first core shaft.

49. A method as recited in claim 46, wherein said guide structure comprises slots formed in at least two primary support arms, said slots being substantially radially aligned with a radius of said winding drum, said primary arms being rotatable about said winding drum axis, said pressure roll being mounted on at least two pressure roll support arms which are rotatably mounted on said primary arms.

50. A method as recited in claim 49, wherein said moving said first core shaft from said first location to a guide structure and through said guide structure to a second location is carried out by rotating said primary support arms, thereby causing said first core shaft to move off of a core shaft supporting surface and into said slots, said first core shaft being moved through said slots by gravity, thereby moving said first core shaft from said first location to said second location.

51. A method as recited in claim 49, wherein during said winding of said web on said first core to produce a growing wound web wound on said first core, said growing wound web being supported by said winding drum and being pressured by said pressure roll, said first core shaft moves within said slots.

52. A method as recited in claim 46, wherein said second support structure comprises at least one support element mounted on each of at least two secondary support arms, at least one support roll mounting element mounted on each of said secondary support arms, said support roll mounting elements supporting said support roll and being movable relative to said secondary support arms, whereby said support roll can be moved relative to said first core and can apply a desired pressure to said growing wound web, said secondary support arms being rotatable relative to a frame along a secondary support arm axis, said secondary support arm axis being substantially parallel to said winding drum axis, said winding drum being mounted on said frame, said primary support arms being mounted on said frame and being rotatable about said winding drum axis, said pressure roll being mounted on at least two pressure roll support arms which are rotatably mounted on said primary arms.

53. A method as recited in claim 46, further comprising closing at least two notch closing slides after said initiating winding of said web onto said first core, said notch closing slides being mounted on respective secondary support arms, said secondary support arms each supporting at least one support element, said support elements comprising said second support structure, said secondary support arms each comprising a notch, said first core shaft being positioned within notches when said notch closing slides are closed, thereby locking said first core shaft in said notches.

54. A method as recited in claim 53, wherein said first core shaft is locked in said notches when said first core shaft, said first core and said wound web wound on said first core are moved to a removal position.

55. A method as recited in claim 46, further comprising spraying an adhesive onto said web prior to and during said cutting said moving web.

56. A method as recited in claim 55, further comprising spraying an adhesive onto said web after said cutting said moving web.

57. A method as recited in claim 46, wherein said first core shaft is rotating at a rotational speed which substantially matches a speed of said moving web before moving said first core shaft from said first position to second position.

58. A method as recited in claim 46, wherein after said cutting said moving web, said pressure roll is switched from a speed mode, where a rate of rotation of said pressure roll substantially matches a speed of said moving web, to a speed limited adjustable torque mode.

59. A method as recited in claim 46, wherein during said continuing winding of said web on said first core while said growing wound web is being supported by said winding drum and said support roll, and said first core shaft is being held in place by a second support structure, said pressure roll is retracted out of contact from said growing wound web.

60. A method as recited in claim 46, wherein during said continuing winding of said web on said first core while said growing wound web is being supported by said winding drum and said support roll, and said first core shaft is being held in place by a second support structure, said support roll is switched from a speed mode, where a rate of rotation of said pressure roll substantially matches a speed of said moving web, to a speed limited adjustable torque mode.

61. A method as recited in claim 46, wherein during said continuing winding of said web on said first core while said growing wound web is being supported by said winding drum and said support roll, and said first core shaft is being held in place by a second support structure, said support roll is switched from a balanced mode, where said support roll merely supports the weight of the first core shaft, the first core and the growing wound web, to a programmed support pressure mode, where said support roll applies supports said weight and also applies pressure to said growing wound web according to a pressure program.

62. A method as recited in claim 46, wherein before said cutting said moving web, said pressure roll is moved into contact with said first core after said first core shaft has been moved to said second location, said pressure roll rotating at a rate of rotation which substantially corresponds to a rate of speed of said moving web.

63. A method as recited in claim 46, wherein a rate of rotation of said first core shaft about said first core shaft axis is increased when said first core shaft reaches said second location and comes into contact with said first surface of said moving web.

64. A method as recited in claim 46, wherein when said first core shaft is in said second location, said first core shaft is sandwiched between said pressure roll and said winding drum, whereby critical speed problems are avoided.

65. A method as recited in claim 46, wherein said first core shaft axis is located in a plane which passes through said axis of said winding drum and which defines an angle of about −20° with respect to a vertical plane which passes through said axis of said winding drum when said cutting said moving web occurs, and said core shaft is moved during said continuing winding of said web on said first core to a position where said first core shaft axis is in a plane which passes through said axis of said winding drum and which defines an angle of about +30° with respect to said vertical plane.

66. A winder for winding a web onto a core shaft, comprising:

a winding drum, said winding drum being driven and being rotatable about a winding drum axis;

at least a first secondary support arm, said first secondary support arm being rotatable about a secondary support arm axis, said secondary support arm axis being substantially parallel to said winding drum axis;

at least a first core shaft support structure for supporting a core shaft rotatably with respect to a core shaft axis which is substantially parallel to said winding drum axis, said first core shaft support structure being on said first secondary support arm; and a support roll mounted on said secondary support arm, said support roll being rotatable about a support roll axis, said support roll axis being substantially parallel to said winding drum axis.

67. A winder as recited in claim 66, further comprising at least a second secondary support arm, said second secondary support arm being rotatable about said secondary support arm axis;

said support roll being mounted on said first and second secondary support arms;

said second secondary support arm having a second core shaft support structure, said first core shaft support structure and said second core shaft support structure being adapted to cooperate to support a core shaft.

68. A winder as recited in claim 66, further comprising a core shaft, a core and a moving web, said core shaft being at least partially supported by said first core shaft support structure, said core being mounted on said core shaft, and at least a portion of said moving web being wound on said core to form a wound web.

69. A winder as recited in claim 66, wherein said support roll is movable relative to said first secondary support arm with said support roll axis remaining substantially parallel to said winding drum axis.

70. A method of winding a web onto a core shaft, comprising:

winding a moving web onto a wound web which is wound around a core shaft while said core shaft is rotating about a core shaft axis, said moving web passing between and in contact with said wound web and a winding drum, said moving web also passing between and in contact with said wound web and a support roll, said winding drum rotating about a winding drum axis which is substantially parallel to said core shaft axis, said support roll rotating about a support roll axis which is substantially parallel to said core shaft axis, said core shaft and said support roll each being at least partially supported by a first secondary support arm;

cutting said moving web; and pivoting said first secondary support arm about a first secondary support arm axis, said first secondary support arm axis being substantially parallel to said core shaft axis.

71. A method as recited in claim 70, further comprising moving said support roll relative to said first secondary support arm from a first position where said support roll is not in contact with said moving web to a second position where said support roll is in contact with said moving web, said support roll axis being substantially parallel to said core shaft axis while said support roll is in said first position and while said support roll is in said second position.

72. A method as recited in claim 70, further comprising causing said support roll to apply pressure to said wound web in order to brake said core shaft and wound web to reduce a rate of rotation of said core shaft about said core shaft axis.

* * * * *

UNITED STATES PATENT AND TRADEMARK OFFICE

CERTIFICATE OF CORRECTION

PATENT NO. : 6,834,824 B1
DATED : December 28, 2004
INVENTOR(S) : R. Duane Smith It is certified that error appears in the above-identified patent and that said Letters Patent is hereby corrected as shown below:

Column 9,
Line 16, add -- , -- after "time"

Column 14,
Line 18, change "slots" to -- slot --
Line 21, change "drawn" to -- drum --

Signed and Sealed this

Nineteenth Day of April, 2005

JON W. DUDAS
*Director of the United States Patent and Trademark Office*